US006084208A

United States Patent [19]

Okuda et al.

[11] Patent Number: 6,084,208

[45] **Date of Patent: *Jul. 4, 2000**

[54] IMAGE HEATING DEVICE WHICH PREVENTS TEMPERATURE RISE IN NON-PAPER FEEDING PORTION, AND HEATER

[75] Inventors: Koichi Okuda; Tatsunori Ishiyama, both of Yokohama; Takashi Shibuya, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/791,542

[22] Filed: Jan. 31, 1997

Related U.S. Application Data

[63] Continuation of application No. 08/201,226, Feb. 24, 1994, abandoned.

[30] Foreign Application Priority Data

Feb. 26, 1993 [JP] Japan ..... 5-038408
Mar. 26, 1993 [JP] Japan ..... 5-068203

[51] Int. Cl.[7] ..... G03G 15/20; H05B 3/16

[52] U.S. Cl. ..... 219/216; 219/543; 399/329

[58] Field of Search ..... 219/216, 543; 399/328, 329, 335, 338

[56] References Cited

U.S. PATENT DOCUMENTS

| | | | |
|---|---|---|---|
| 4,354,092 | 10/1982 | Manabe et al. | 219/543 |
| 5,006,696 | 4/1991 | Uchida et al. | 219/543 |
| 5,149,941 | 9/1992 | Hirabayashi et al. . | |
| 5,253,024 | 10/1993 | Okuda et al. . | |
| 5,262,834 | 11/1993 | Kusaka et al. . | |
| 5,285,049 | 2/1994 | Fukumoto et al. | 219/216 |
| 5,338,919 | 8/1994 | Tagashira et al. | 219/216 |
| 5,343,021 | 8/1994 | Sato et al. | 219/216 |
| 5,376,773 | 12/1994 | Masuda et al. | 219/543 |
| 5,391,861 | 2/1995 | Ooyama et al. | 219/216 |

*Primary Examiner*—Gregory Mills
*Attorney, Agent, or Firm*—Fitzpatrick, Cella, Harper & Scinto

[57] ABSTRACT

An image heating device of film heating type is provided with a heater, and a film which is moved while one surface thereof contacts the heater, and the other surface thereof contacts a recording member which supports an image. The heater is provided with a resistor for generating heat upon energization, and an energization electrode arranged to alternately have different polarities in a direction perpendicular to a feeding direction of the recording member.

14 Claims, 16 Drawing Sheets

IMAGE HEATING DEVICE WHICH PREVENTS TEMPERATURE RISE IN NON-PAPER FEEDING PORTION, AND HEATER

This application is a continuation of application Ser. No. 08/201,226 filed Feb. 24, 1994 now abandoned.

BACKGROUND OF THE INVENTION

1. Field of the Invention

The present invention relates to a film heating type image heating device which brings a heat-resistant film into sliding contact with a heater which generates heat upon energization, brings a member to be heated into tight contact with a surface, opposite to the heater, of the film, and passes the member to be heated together with the film at the position of the heater, thereby applying heat energy from the heater to the member to be heated via the film, and a heater used in the image heating device.

2. Related Background Art

As the above-mentioned film heating type heating device, U.S. Pat. No. 5,149,941, U.S. patent application Ser. No. 444,802, and the like previously proposed by the present applicant are known. Such a heating device can be utilized as an image heating/fixing device for an image forming apparatus such as an electrophotographic copying machine, a printer, a facsimile apparatus, or the like, i.e., an image heating/fixing device for heating and fixing a non-fixed image visualizing agent (toner) image corresponding to target image information and formed by a direct or indirect (transfer) method on the surface of a recording member (an electro-facsimile sheet, an electrostatic recording sheet, a transfer medium sheet, a print sheet, or the like) using a toner consisting of a hot-melt resin by image forming process means such as electrophotography means, electrostatic recording means, magnetic recording means, or the like.

For example, the heating device can also be used as a device for improving the surface property such as gloss by heating a recording member which carries an image, a device for temporarily fixing an image on a recording member, or the like.

More specifically, the film heating type image heating device comprises a thin heat-resistant film (sheet), movement driving means for the film, a heater which is fixed and supported on one surface side of the film, and a pressing member arranged to oppose the heater on the other surface side of the film, for bringing an image visualizing agent (toner) image carrying surface of a recording member on which an image is to be fixed into contact with the heater via the film. The image heading device operates based on the following principle. That is, at least during execution of image fixing processing, the film is fed at the same speed and the same direction as those of a recording member, which is fed between the film and the pressing member, and is subjected to the image fixing processing, and the recording member is caused to pass a fixing nip portion as a fixing portion defined by a press contact state between the heater and the pressing member to sandwich the fed film therebetween. Thus, the toner image carrying surface of the recording member is heated by the heater via the film to apply heat energy to a non-fixed toner image, and to soften and melt the toner image. Thereafter, the film and the recording member which have passed the fixing portion are separated at the separation point.

FIG. 13 is a partially cutaway plan view of a heater used in the film heating type fixing device, and a block diagram of an energization control system.

A heater 2 shown in FIG. 13 comprises:

a. an electrically insulating, heat-resistant, and low-heat capacity elongated ceramic substrate 3, which has its longitudinal direction extending in a direction substantially perpendicular to the feeding direction of a heat-resistant film 1, and consists of, e.g., $Al_2O_3$ (alumina), AlN, SiC, or the like;

b. an energization heat generating member 4 which is formed into a stripe- or band-shaped pattern along the longitudinal direction of the substrate at the central portion, in the widthwise direction, of one surface (face) of the substrate 3, serves as a heat source, and consists of a silver/palladium alloy (Ag/Pd), or the like;

c. power supply electrodes 5, 6, and 6' formed on the substrate surface to be electrically connected to the two end portions of the energization heating member 4, and through holes 50;

d. an electrically insulating overcoat layer 7 of, e.g., glass serving as a surface protective layer which covers the energization heating member forming surface of the substrate 3;

e. a temperature detection element 8 such as a thermistor and a temperature fuse 9 as a temperature detection element (thermal protector) for a safety countermeasure, which are arranged to be in contact with the other surface side (back side) of the substrate 3; and the like.

The overcoat layer 7 side of the heater 2 corresponds to the film sliding contact surface side, and the heater 2 is fixed and supported by a support portion (not shown) via a heat-insulating heater holder 13 to expose this surface side externally.

The temperature of the heater 2 rises when a voltage is applied from an AC power supply 20 across the power supply electrodes 5 and 6 at the two ends of the energization heating member 4, and the energization heating member 4 generates heat.

The temperature of the heater 2 is detected by the temperature detection element 8 on the back side of the substrate, and the detected information is fed back to an energization control unit 15. The control unit 15 controls energization from the AC power supply 20 to the energization heating member 4 based on the detected information, thereby executing temperature control, so that the temperature of the heater 2 detected by the temperature detection element 8 upon execution of fixing becomes a predetermined temperature (fixing temperature).

The temperature control of the heater 2 is realized by adopting a method of controlling the applied voltage or current to the energization heating member 4, or a method of controlling the energization time. As the method of controlling the energization time, zero-crossing wave number control for controlling energization and non-energization states in units of half cycles of a power supply waveform, and phase control for controlling the phase angle to be energized in units of half cycles of a power supply waveform are known.

More specifically, the output from the temperature detection element (thermistor) 8 is A/D-converted, and is fetched by a CPU. Based on the fetched information, an AC voltage to be applied to the energization heating member 4 is pulse-width-modulated by the phase control, wave number control, or the like by an SSR (solid state relay) having a TRIAC and the like, thereby controlling energization to the energization heating member 4, so that the temperature of the heater detected by the temperature detection element 8 becomes constant.

The temperature fuse 9 is arranged in the vicinity of or to be in contact with the back of the substrate 3 of the heater 2 while being connected in series with the energization path to the energization heating member 4. When the energization control of the energization heating member 4 goes wrong, and the heater 2 causes an abnormal temperature rise (thermal runaway of the heater), the temperature fuse 9 operates to open the energization circuit to the energization heating member 4, thereby disabling energization to the energization heating member.

In the above-mentioned film heating type device, since the heater 2 having a low heat capacity can be used, the wait time can be shortened as compared to a conventional heat roller type heating device (quick start characteristic). In addition, since a quick start is allowed, the above-mentioned device does not require a preheating process when it is in idle, thus attaining savings in total power consumption. Also, the above-mentioned device has a merit capable of solving various drawbacks of devices of other heating types, and is effective.

However, a resistor material used in the energization heating member of the heater is normally a noble metal (e.g., Ag/Pd), and is very expensive.

When such a material is replaced by an inexpensive material to reduce cost, the inexpensive material has a high volume resistance value, and cannot be used in the conventional device.

More specifically, the heater must generate electric power capable of obtaining a predetermined temperature rise or higher within a limited period of time. On the other hand, a power supply voltage to be supplied to the heater is normally a commercial power supply voltage (AC 100/200 V), and is fixed. Therefore, the resistance value of the heater must be equal to or smaller than a predetermined value.

The resistance value of the heater is determined by the thickness, the width (in the feeding direction of a recording member), the length (in a direction perpendicular to the feeding direction of a recording member), and the volume resistance of the energization heating member. The length is almost the same as the width of a recording member, and is fixed. As for the width, when the width is set to be larger than the nip width, it is not effective since heat generated by a portion extending outside the nip is not conducted to a recording member. An increase in thickness of the heating member is limited by a manufacturing method such as screen printing.

More specifically, in order to set the resistance value of the heater to be equal to or smaller than a predetermined value, the volume resistance value of the energization heating member must be set to be a predetermined value or less. For this reason, an inexpensive resistor cannot be used as long as it has a high volume resistance value.

In the above-mentioned film heating system, when a heating/fixing operation is continuously performed using small recording members, a difference between heat dissipation amounts of a portion which contacts the recording member and a portion which does not contact the recording member is generated. More specifically, in an area where a recording member is not fed, the temperatures of the film, the pressing member, and the like become higher than those in an area where the recording member is fed. For this reason, the film, the pressing member, and the like corresponding to a non-paper feeding area thermally deteriorate. This phenomenon is called a non-paper feeding portion temperature rise.

SUMMARY OF THE INVENTION

It is an object of the present invention to provide an image heating device and a heater, which can use a resistor having a high volume resistance value as a heating member.

It is another object of the present invention to provide an image heating device and a heater, which can prevent a non-paper feeding portion temperature rise.

It is still another object of the present invention to provide an image heating device comprising:

a heater; and a film which is moved while one surface thereof contacts the heater, and the other surface thereof contacts a recording member which supports an image, the heater comprising a resistor for generating heat upon energization, and an energization electrode arranged to alternately have different polarities in a direction perpendicular to a feeding direction of the recording member.

It is still another object of the present invention to provide a heater comprising:

a resistor for generating heat upon energization; and an energization electrode arranged to alternately have different polarities in a longitudinal direction of the resistor.

It is still another object of the present invention to provide an image heating device comprising:

a heater; and a film which is moved while one surface thereof contacts the heater, and the other surface thereof contacts a recording member which supports an image, the heater comprising a heating member for generating heat upon energization, an electrode arranged at an end portion, in a longitudinal direction, of the heating member, and an energization path branching from an intermediate portion, in the longitudinal direction, of the heating member, and the energization path comprising a resistor having a negative temperature—resistance characteristic.

It is still another object of the present invention to provide a heater comprising:

a heating member for generating heat upon energization;

an electrode arranged at an end portion, in a longitudinal direction, of the heating member; and an energization path branching from an intermediate portion, in the longitudinal direction, of the heating member, the energization path comprising a resistor having a negative temperature—resistance characteristic.

It is still another object of the present invention to provide an image heating device comprising:

a heater; and a film which is moved while one surface thereof contacts the heater, and the other surface thereof contacts a recording member which supports an image, the heater comprising a heating member for generating heat upon energization, an electrode arranged at an end portion, in a longitudinal direction, of the heating member, and an energization path branching from an intermediate portion, in the longitudinal direction, of the heating member, and the energization path comprising a switching element which is enabled at a temperature not less than a predetermined temperature.

It is still another object of the present invention to provide a heater comprising:

a heating member for generating heat upon energization;

an electrode arranged at an end portion, in a longitudinal direction, of the heating member; and an energization path branching from an intermediate portion, in the longitudinal direction, of the heating member, the energization path comprising a switching element which is enabled at a temperature not less than a predetermined temperature.

Other objects of the present invention will become apparent from the following description.

BRIEF DESCRIPTION OF THE DRAWINGS

FIG. 8A is a plan view of the heater, and FIGS. 8B to 8E show the respective relationships between position of the heater and temperature in area X, resistance value of each heating segment, heating amount of each heating segment and temperature in area X;

FIG. 9A is a plan view of the heater, and FIGS. 9B to 9E show the relationships corresponding to FIGS. 8B to 8E, respectively;

FIG. 10A is a plan view of the heater, and FIGS. 10B to 10E show the relation-ship corresponding to FIGS. 8B to 8E, respectively;

FIG. 21A is a back view of the heater, FIG. 21B is a front view thereof, and FIG. 21C is a side view thereof.

DESCRIPTION OF THE PREFERRED EMBODIMENTS

Figure 1:
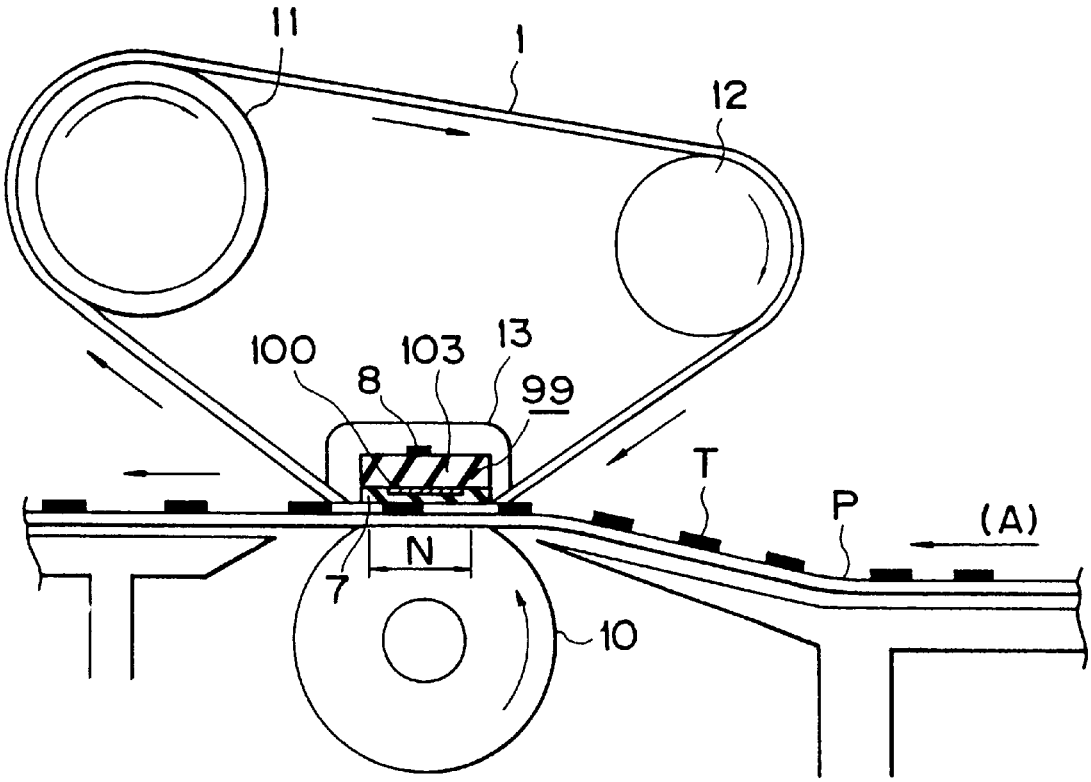
FIG. 1 is a longitudinal sectional view showing a heating device according to an embodiment of the present invention.
Figure 2:
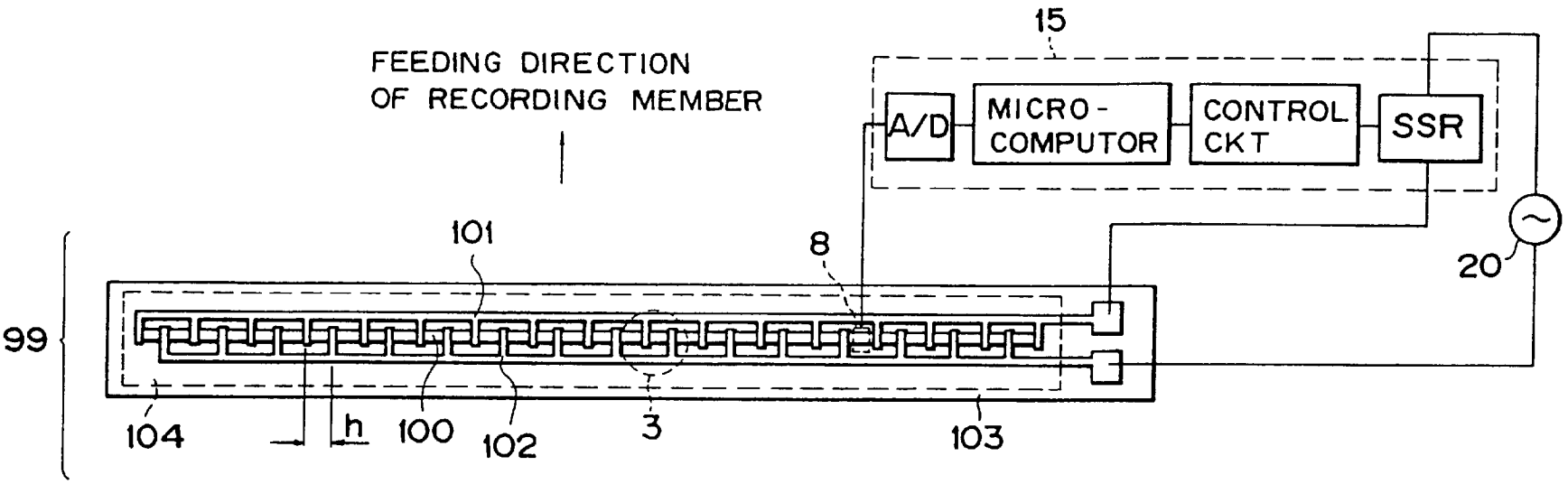
FIG. 2 is a plan view of a heater according to the embodiment of the present invention.
Figure 3:
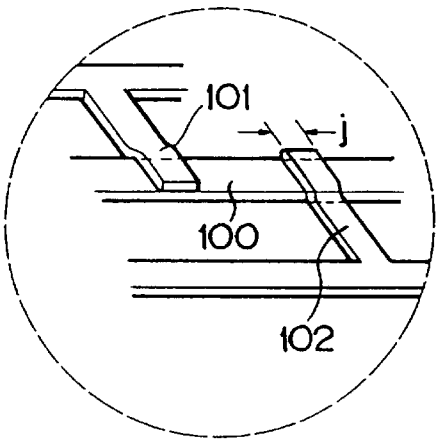
FIG. 3 is a partially enlarged perspective view of the heater shown in FIG. 2.

FIGS. 1, 2, and 3 show a heating device according to an embodiment of the present invention.

Referring to FIG. 1, an endless belt-like heat-resistant film (fixing film) 1 is looped on three members, i.e., a driving roller 11, a driven roller 12, which is arranged to be substantially parallel to the driving roller, and also serves as a tension roller, and a heater 99.

In order to improve the quick start characteristic by reducing the heat capacity, the film 1 comprises a single-layered film of PTFE, PFA, or the like having a high heat resistance, a mold release characteristic, a high mechanical strength, a high durability, and the like, or a two-layered film prepared by coating a film of PTFE, PFA, FEP or the like as a mold release layer on the surface of a film of polyimide, polyamideimide, PEEK, PES, PPS, or the like. The single- or two-layered film has a total film thickness of 100 $\mu$m or less and, more preferably, 20 $\mu$m to 40 $\mu$m.

A heater holder 13 supports the heater 99 in a heat insulating state. A pressing roller 10 presses the film 1 against the surface of the heater 99 at a total pressure of 4 to 15 kg to sandwich the film 1 between itself and the heater 99. The pressing roller 10 has a rubber elastic layer of, e.g., silicone rubber having a high mold release characteristic.

The film 1 is rotated at a predetermined peripheral velocity while being in sliding contact with the surface of the heater 99, in the clockwise direction indicated by an arrow in FIG. 1 upon rotation of the driving roller 11 at least during execution of image fixing processing. In this case, the film 1 is rotated in a wrinkle-free state at substantially the same peripheral velocity as the feeding speed of a recording member P which is fed from the image forming portion (A) side (not shown), and carries a non-fixed toner image T thereon.

The heater 99 includes an energization heating member (resistive heating member) 100 as a heat source for generating heat upon reception of supplied electric power, as will be described later, and the temperature of the heater 99 rises when the energization heating member 100 generates heat. The energization heating member 100 is arranged on a substrate 103.

In a state wherein the heater 99 is heated upon electric power supply to the energization heating member 100, and the film 1 is rotated, the recording member P is fed to a portion between the film 1 and the pressing roller 10 in a nip portion N (fixing nip portion) between the heater 99 and the pressing roller 10. Thus, the recording member P is brought into tight contact with the film 1, and passes the nip portion N in an overlapping state with the film.

While the recording member passes the press-contact portion, heat energy is applied from the heater 99 to the recording member P via the film 1, and the non-fixed toner image T on the recording member P is thermally melted and fixed. The recording member P is separated from the film 1 after it passes the nip portion N, and is exhausted.

Referring to FIG. 2, the energization heating member 100 is formed on the heat-resistant substrate 103 of, e.g., alumina, and interdigital electrodes 101 and 102 having different polarities are alternately arranged at equal intervals h in a direction perpendicular to the feeding direction of the recording member on the energization heating member. A glass insulating layer 104 is coated on the energization heating member 100, and the electrodes 101 and 102.

The heater 99 is mounted in, e.g., the fixing device shown in FIG. 1, and energization from an AC power supply is controlled by a control unit 15 on the basis of information from a thermistor (temperature detection element) 8. More specifically, the control unit 15 A/D-converts an output from the temperature detection element 8, and fetches digital data in a CPU. Then, the control unit 15 pulse-width-modulates an AC voltage to be applied to the energization heating member 100 by the phase control, wave number control, or the like using an SSR (solid state relay) having a TRIAC and the like, thereby controlling energization to the energization heating member 100, so that the temperature of the heater detected by the temperature detection element 8 becomes constant.

When the heater adopts the above-mentioned arrangement, a predetermined resistance value of the heater can be obtained by changing the electrode interval or a length h of a heating segment even when a material, e.g., $RuO_2$ having a very high volume resistance, is used.

As the material of the electrodes 101 and 102, a material such as Ag/Pt, Ag/Pd, Au, Pd, or the like, which does not easily cause electron migration is preferably used rather than Ag or the like so as to prevent short-circuiting caused by electron migration.

As shown in FIG. 3, if a joint width j between the electrode 101 or 102 and the energization heating member 100 is too large, the corresponding portion causes a fixing error in a vertical stripe pattern on the recording member since this portion is a non-heat generating portion. In order to prevent this error, the junction width j is preferably set to be about 1 mm or less.

Figure 4:
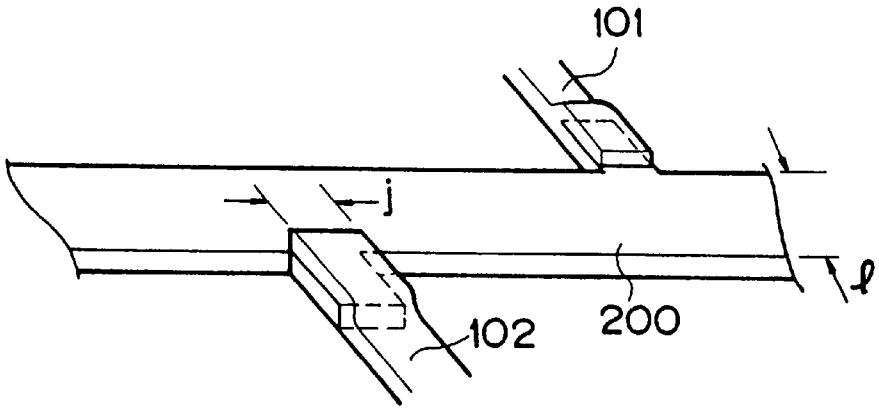
FIG. 4 is a detailed view showing an example of an electrode joint portion of the heater according to the embodiment of the present invention.

As shown in FIG. 4, when the joint portion between the electrode 101 or 102 and the energization heating member 100 is located outside a width l of the energization heating member 100, a non-heating portion can be prevented from being locally formed in the energization heating member 100. Therefore, the width j of the electrode 101 or 102 can be large, and a large current can be supplied.

Figure 5:
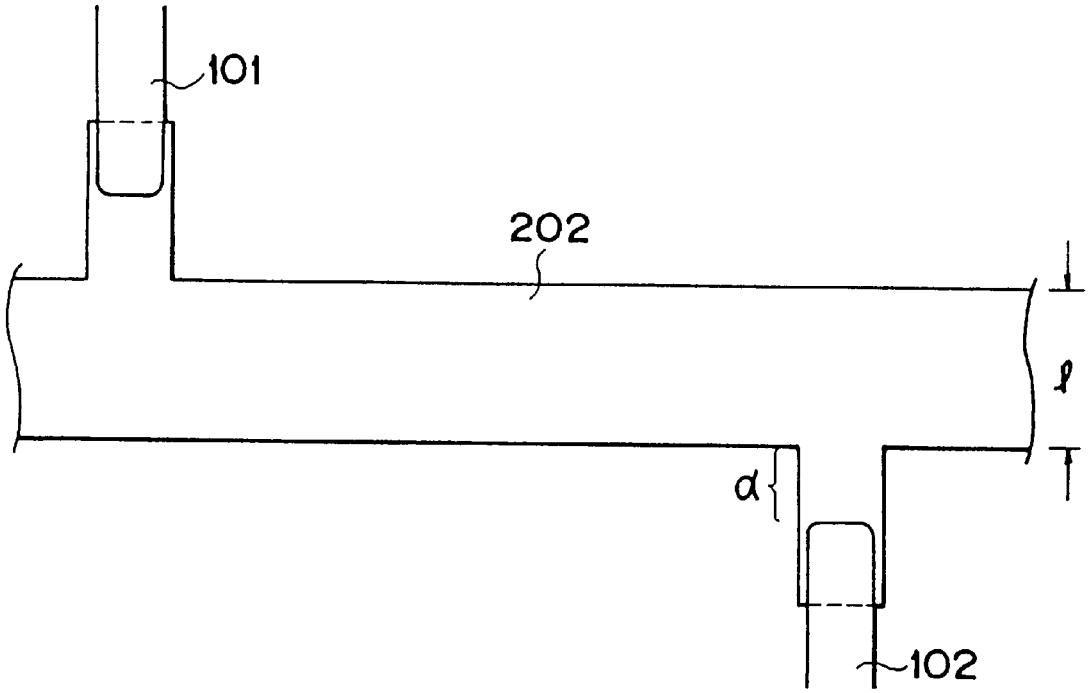
FIG. 5 is a detailed view showing another example of the electrode joint portion of the heater according to the embodiment of the present invention.
Figure 6:
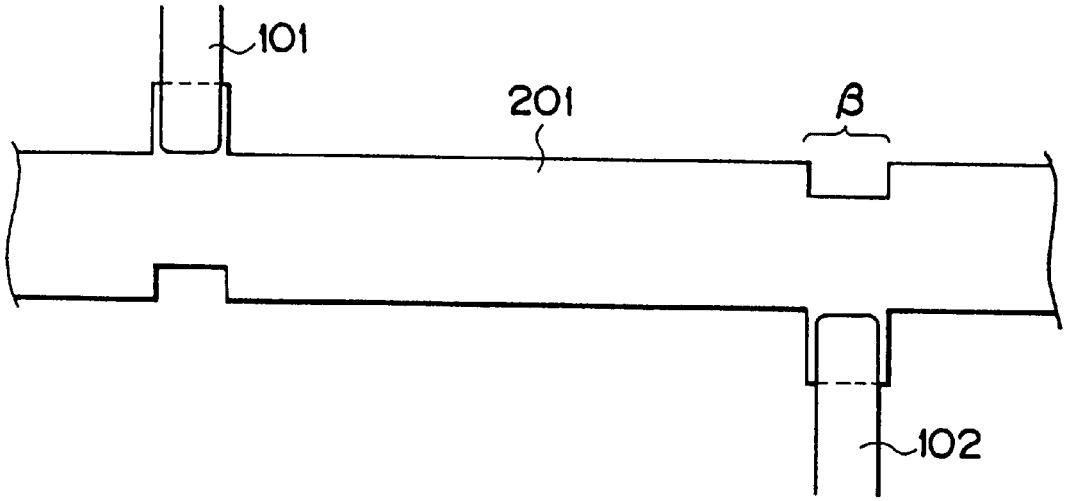
FIG. 6 is a detailed view showing still another example of the electrode joint portion of the heater according to the embodiment of the present invention.
Figure 7:
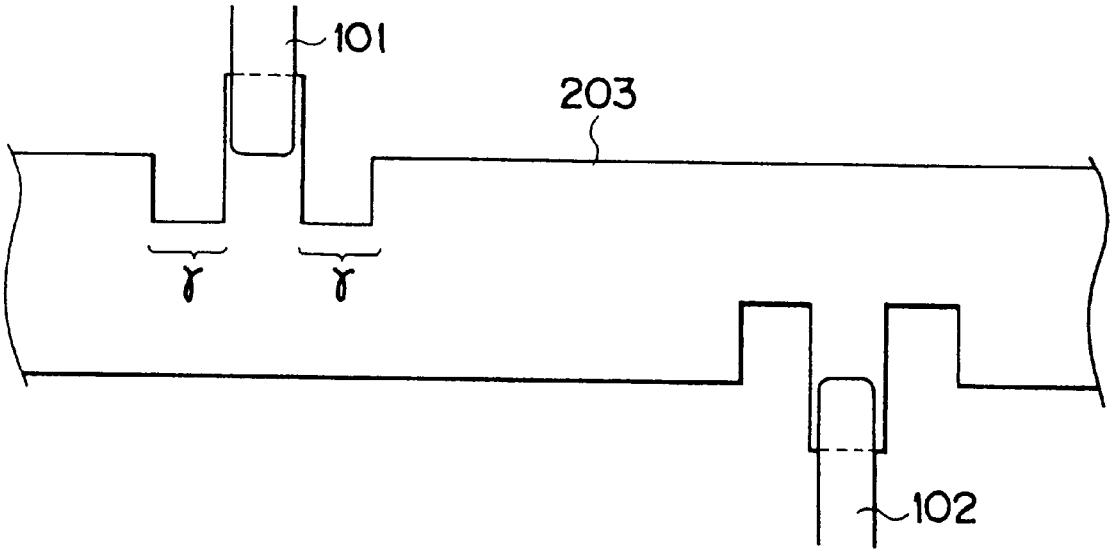
FIG. 7 is a detailed view showing still another example of the electrode joint portion of the heater according to the embodiment of the present invention.

Furthermore, in order to compensate for heat dissipation from the electrodes 101 and 102, the energization heating member portion may be extended like a portion $\alpha$ in FIG. 5, so that some heat components are generated even outside the width l of the energization heating member. Alternatively, the width of energization heating member may be decreased at an electrode joint portion like portions $\beta$ in FIG. 6 or portions $\gamma$ in FIG. 7 so as to locally increase the heating amount.

Since the energization heating member consists of a material having a large positive temperature—resistance characteristic, a non-paper feeding portion temperature rise can be prevented.

More specifically, when a recording member having a width smaller than a maximum paper feeding width of the heating device is used, although the heating amount on a paper feeding area is the same as that on a non-paper feeding area, the temperature on the non-paper feeding area becomes higher than that on the paper feeding area since these areas, i.e., an area from which heat is removed by conduction to the recording member, and an area from which such no heat removal occurs, have different heat dissipation amounts (the temperature on the paper feeding area is controlled by the thermistor 8 to become constant). For this reason, when such a phenomenon frequently occurs, members such as the film, the pressing roller, and the like on the non-paper feeding area are deteriorated by high temperatures.

Thus, the energization heating member consists of a material having a large positive temperature—resistance characteristic (TCR), and when the temperature on the non-paper feeding area rises, the resistance value of the corresponding portion increases to decrease the heating amount, thus eliminating a non-paper feeding portion temperature rise.

Figure 8A:
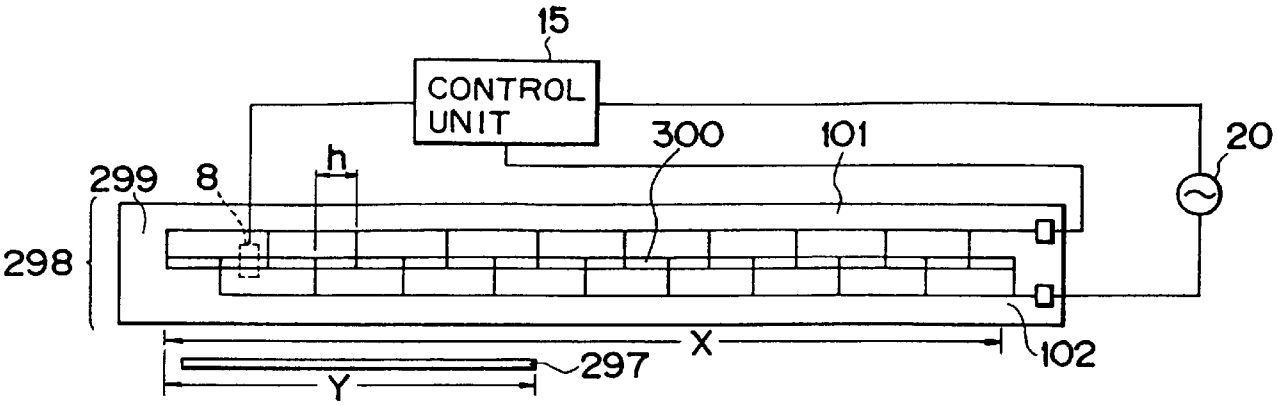
FIGS. 8A, 8B, 8C, 8D, and 8E are operation explanatory views for explaining that a non-paper feeding portion temperature rise can be improved by the embodiment of the present invention.

More specifically, as shown in FIG. 8A, the interdigital electrodes 101 and 102 are alternately arranged at equal intervals h on an energization heating member 300 having a large positive temperature—resistance characteristic (preferably, about 1,000 PPM/° C. or more). At this time, each heating segment (an energization heating member portion of a length h sandwiched between the electrodes having different polarities) has an equal resistance value. As the material of the energization heating member, for example, a material prepared by mixing Au in $RuO_2$ may be used, and its TCR is about 4,000 PPM/° C.

A heater 298 is formed as follows:

① The energization heating member 300 is printed by screen printing on a heat-resistant ceramic substrate 299 of, e.g., $Al_2O_3$, AlN, or the like using a thick film paste containing $RuO_2$+Au.

The thick film paste is prepared by mixing $RuO_2$ and Au powders each having a particle size of 50 $\mu$m or less (these powders are used to impart conductivity to the paste), an inorganic binder powder obtained by mixing an additive such as $Bi_2O_3$, PbO, ZnO, CaO, CuO, or the like in a glass such as borosilicate, aluminum silicate, or the like (this binder is used for adhering the paste to the ceramic substrate), an organic binder such as ethyl cellulose for providing paste-like fluidity to the paste, and a high-boiling point solvent such as terpineol, butyl carbitol, or the like.

A commercially available $RuO_2$ thick film paste normally has a TCR of about 100 PPM/° C. When Au having a high TCR is mixed in this paste, a TCR of 4,000 PPM/° C. is attained.

The substrate on which the energization heating member is printed is dried and calcined at a high temperature to burn out the solvent and the organic binder, and to melt the inorganic binder, thereby adhering the energization heating member to the ceramic substrate.

② Then, the electrodes 101 and 102 are printed by screen printing using a thick film paste consisting of Au, Ag, Ag/Pd, Ag/Pt, or the like, and the printed paste is calcined to form the electrodes.

③ Furthermore, a glass coat as an insulating layer (not shown) is formed on the energization heating member and the electrodes. The glass coat is also formed by screen-printing and calcining a thick film paste.

Energization from the power supply 20 to the heater 298 is controlled, so that the temperature detected by the thermistor 8 arranged on the back side of the substrate 299 at a position of one heating segment becomes constant.

Figure 8B:
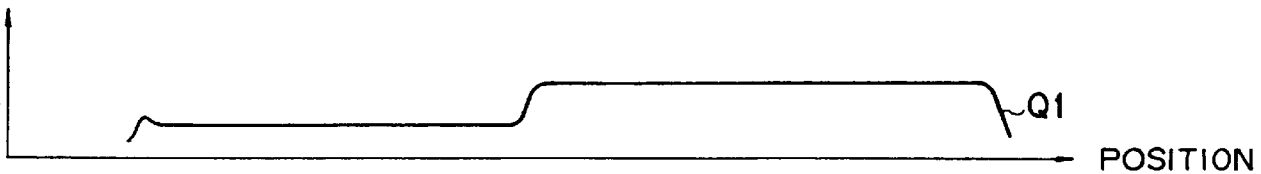
Figure 8C:
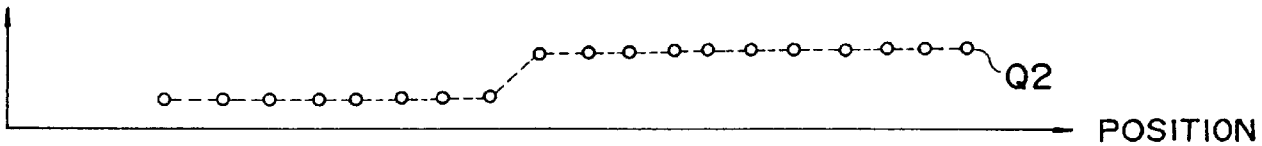
Figure 8D:
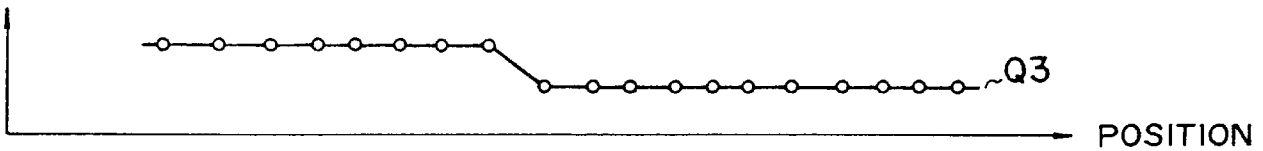
Figure 8E:
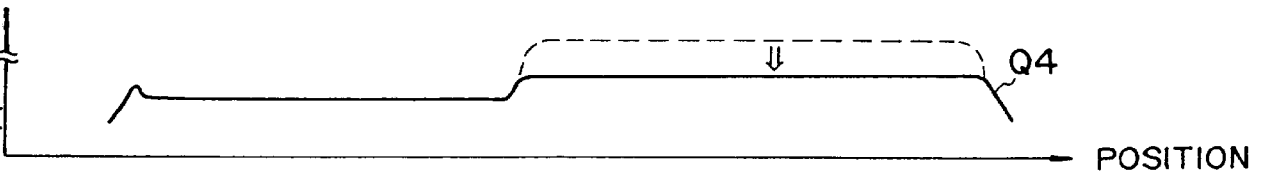

Assuming that a recording member 297 having a width Y smaller than a maximum paper feeding width X of the heater 298 is fed, as shown in FIG. 8A, a temperature Q1 of a non-paper feeding area rises due to a difference in heat dissipation load (FIG. 8B). Then, a resistance value Q2 of the heating segment on a non-paper feeding area increases (FIG. 8C). Since the heating amount of each heating segment is determined by $V^2/R$ (V: the voltage across the electrodes 101 and 102, R: the resistance value of each heating segment), a heating amount Q3 of the heating segment on the non-paper feeding area decreases (FIG. 8D), and a temperature Q4 decreases (FIG. 8E), thus eliminating a non-paper feeding portion temperature rise.

Figures 9A, 9B, 9C, 9D, 9E:
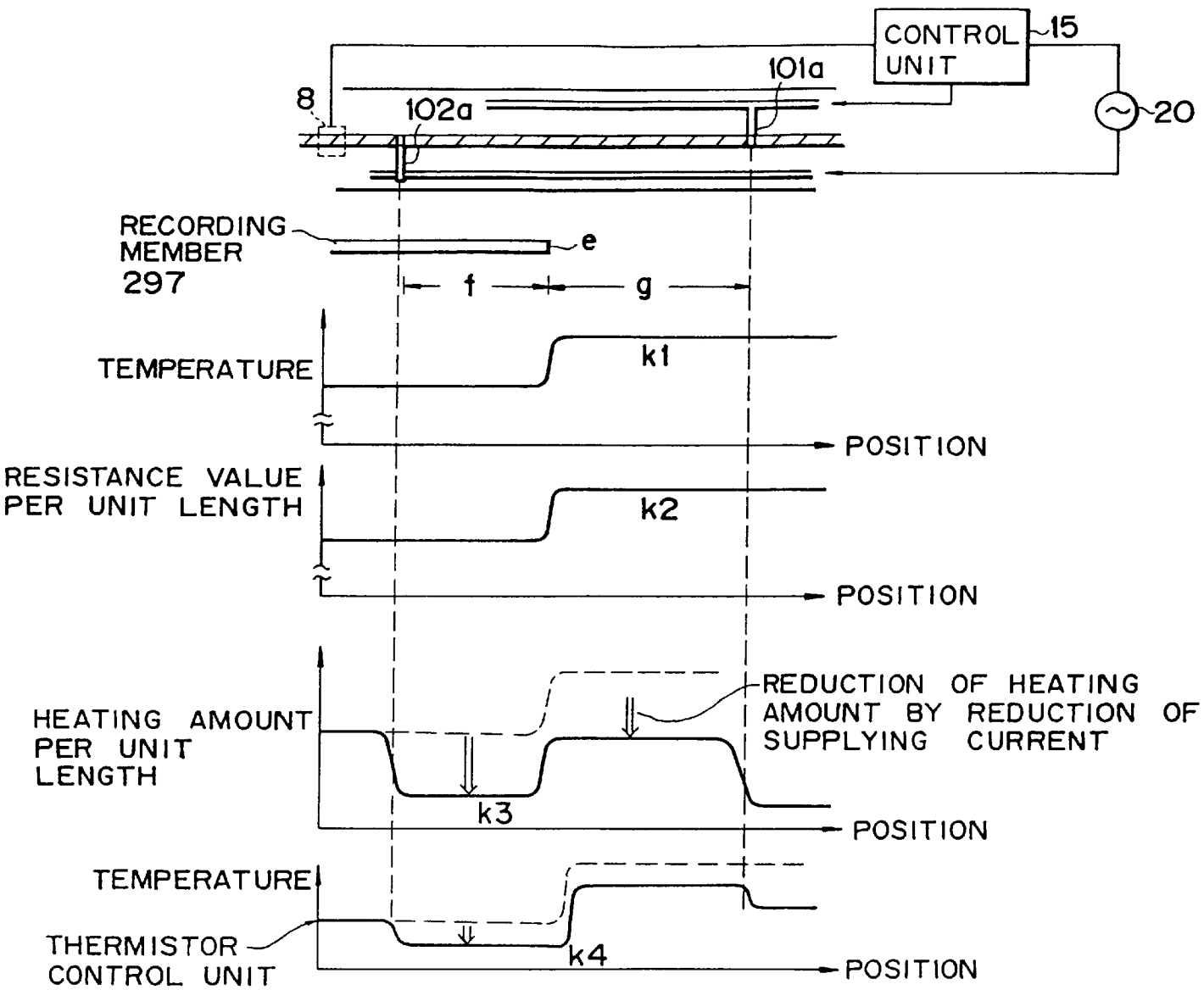
FIGS. 9A, 9B, 9C, 9D, and 9E are explanatory views for explaining an operation according to the embodiment of the present invention.

In this case, if each heating segment has a large length h, and an edge e of the recording member is located at an intermediate portion between electrodes 101*a* and 102*a*, as shown in FIG. 9A, the heating amount per unit length of an area f decreases, and the temperature decreases, thus causing a fixing error. More specifically, as shown in FIG. 9A, when the recording member 297 passes the area f portion, a temperature k1 on a non-paper feeding area increases (FIG. 9B), and a resistance value k2 per unit length increases (FIG. 9C) (since the temperature of the area f as a paper feeding area does not change, no change in resistance value per unit length occurs). Since the heating amount per unit length is defined by $I^2r$ (I is the current across the electrodes 101*a* and 102*a*, and r is the resistance value per unit length), the heating amount per unit length of the area f becomes smaller than the heating amount per unit length of an area g. In this case, since the total resistance value between the electrodes 101*a* and 102*a* increases, and the total current value flowing across the electrodes 101*a* and 102*a* decreases, a heating amount K3 per unit length of the area f decreases (FIG. 9B), and a temperature K4 decreases (FIG. 9E), thus causing a fixing error.

The above-mentioned case corresponds to a case wherein the thermistor 8 is present on a paper feeding area other than the heating segment (areas f+g) where the edge e of the recording member is present.

Figures 10A, 10B, 10C, 10D, 10E:
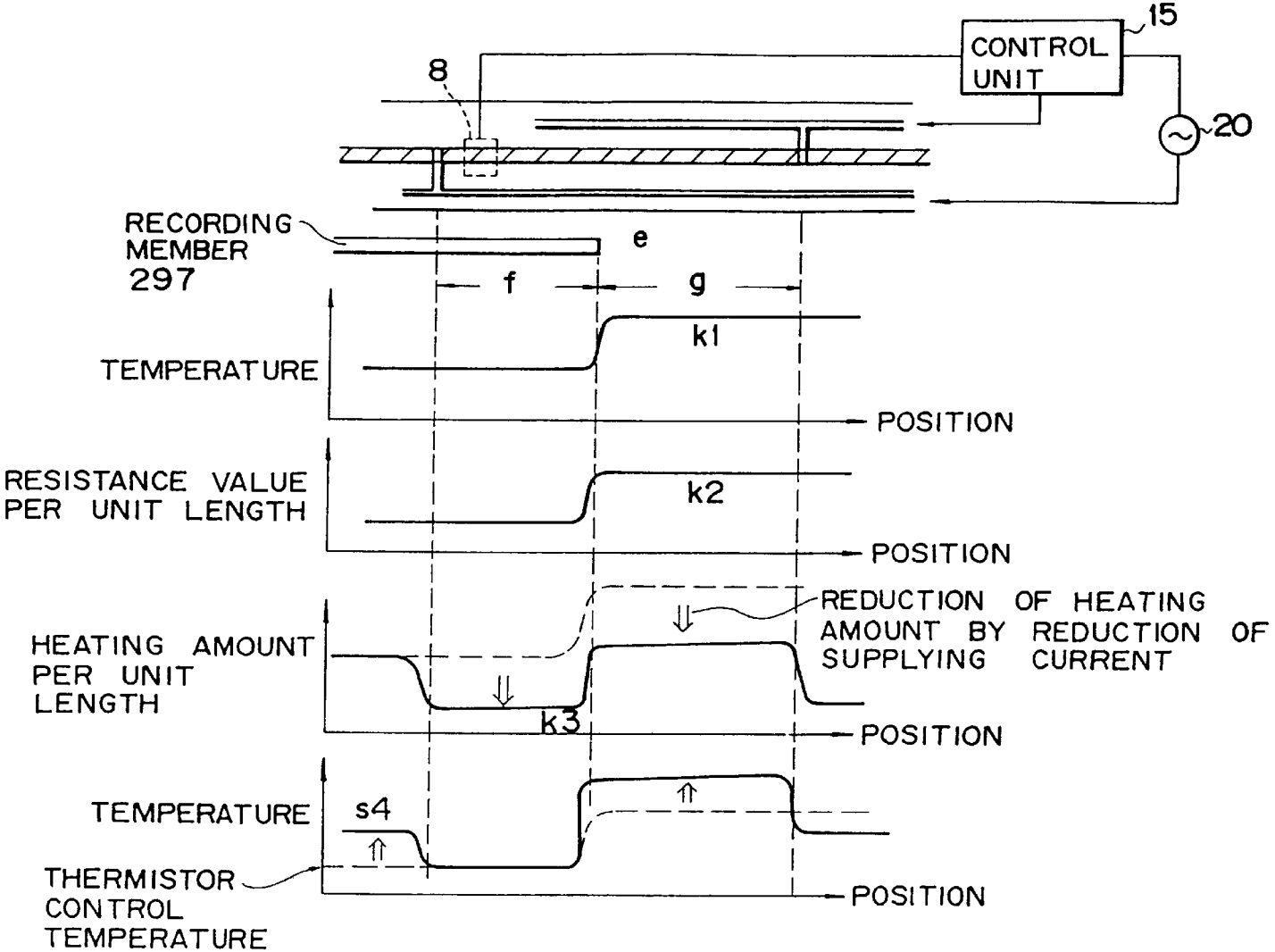
FIGS. 10A, 10B, 10C, 10D, and 10E are explanatory views for explaining an operation according to the embodiment of the present invention.

When the thermistor 8 is present on the paper feeding area (area f) of the heating segment where the edge e of the recording member is present, as shown in FIG. 10A, since the temperature is controlled by the thermistor 8 on the area f as in FIGS. 9B, 9C, and 9D, no fixing error occurs (FIGS. 10B, 10C, and 10D). However, a temperature S4 of another heating segment on the paper feeding area, in turn, increases (FIG. 10E), and a problem of, e.g., a high-temperature offset, is posed. The heating amount, on the non-paper feeding area, of the heating segment where the edge e of the recording member is present becomes very large, and causes thermal deterioration of the film, the pressing roller, and the like. This problem can be solved when the length h of each heating segment is set to be sufficiently small and, preferably, about 20 mm or less. More specifically, heat unevenness generated on paper feeding and non-paper feeding areas by the heating segment where the edge of the recording member is present is reduced by heat conduction in the longitudinal direction of the heater or its peripheral member (in a direction perpendicular to the feeding direction of the recording member), and hardly any temperature difference is generated.

Figure 11:
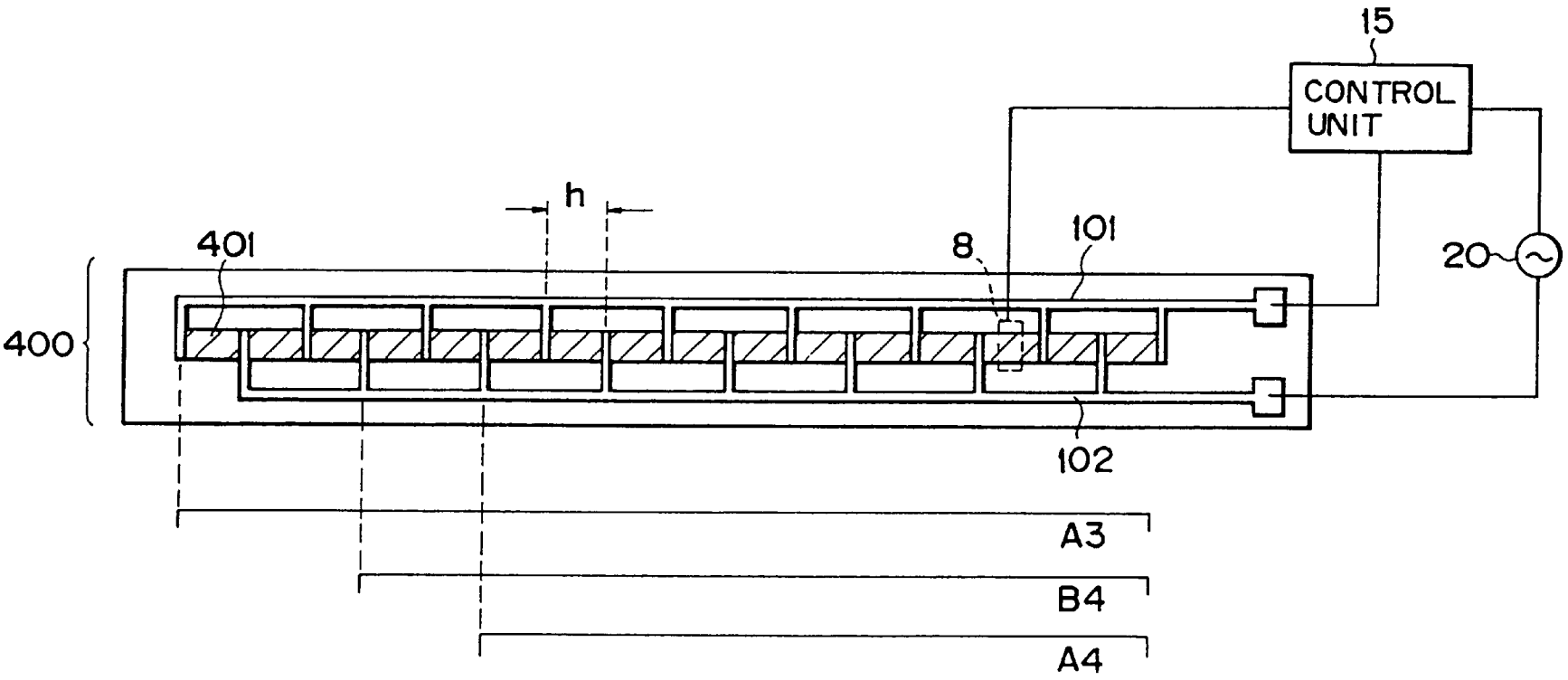
FIG. 11 is one plan view showing the heater according to the embodiment of the present invention.

Also, as in a heater 400 shown in FIG. 11, when the edges of recording members of respective sizes (A3, B4, A4, and the like) are set at the joint positions between the electrodes 101 and 102, and a heating member 401 or the positions of interdigital portions, the above-mentioned problem is not posed even when the length h of each heating segment is large. This is because the above-mentioned problem is posed since both the paper feeding and non-paper feeding areas are present in one heating segment. For this reason, when the edge of the recording member is present at the edge of a heating segment, i.e., at the joint portion between the power supply electrodes 101 and 102, and the heating member 401, one heating segment can be prevented from having both the paper feeding and non-paper feeding areas.

Figure 12:
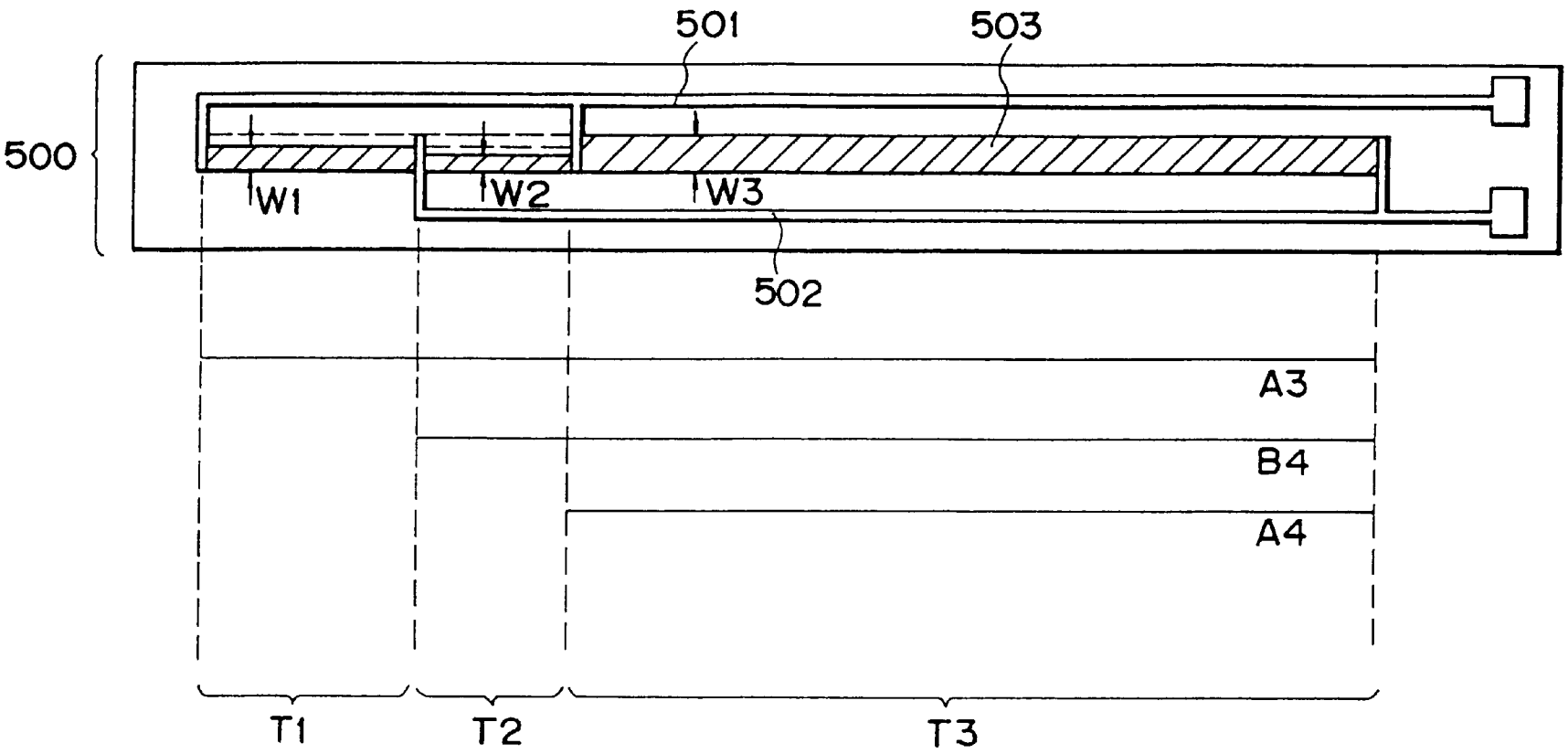
FIG. 12 is another plan view showing the heater according to the embodiment of the present invention.
Figure 13:
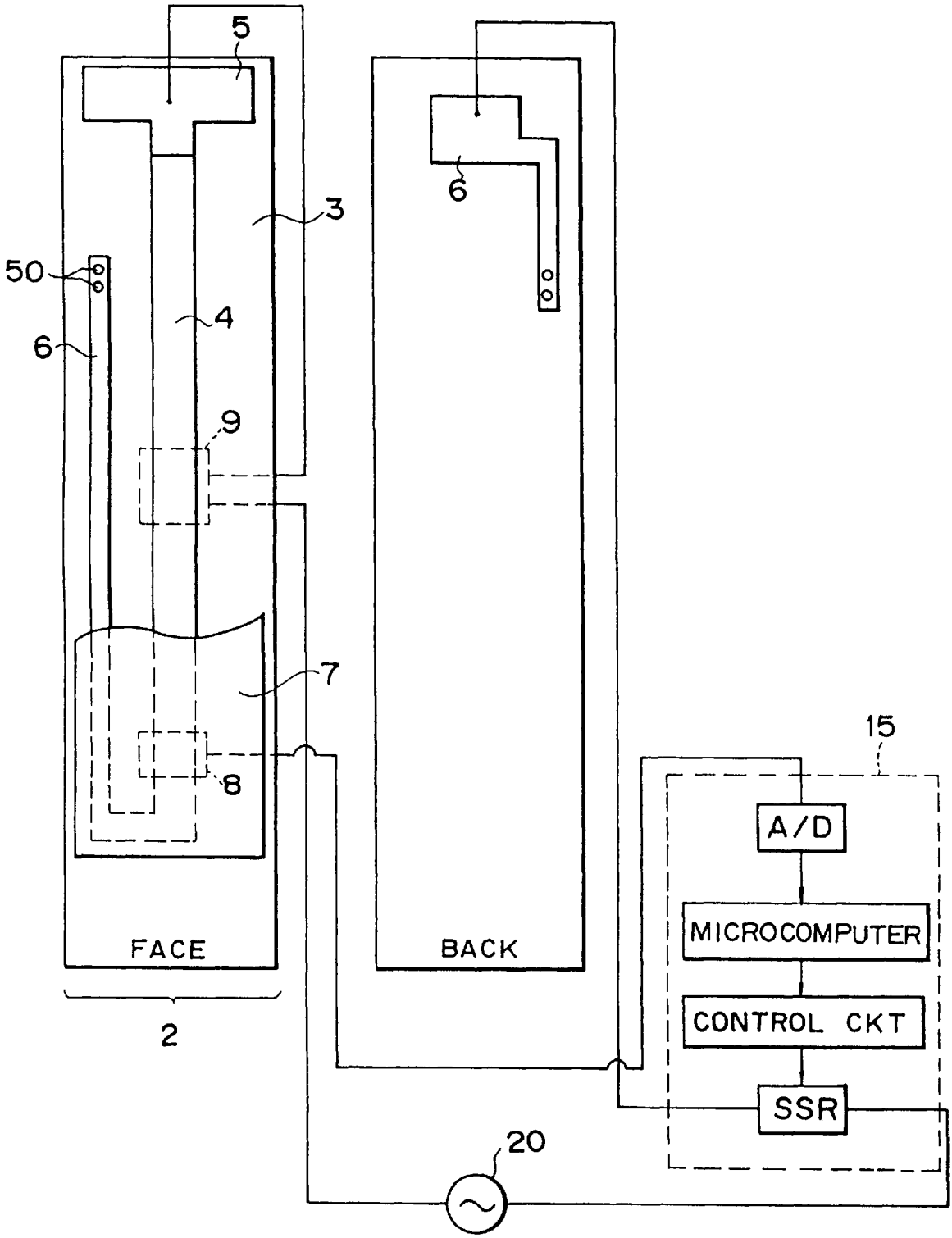
FIG. 13 is a view for explaining an energization method to a heater.

In a heater 500 shown in FIG. 12, lengths $T_1$, $T_2$, and $T_3$ of heating segments are not fixed. The length of each heating segment corresponds to the width of each of various recording members in such a manner that $T_3$ corresponds to the A4 size, $T_2+T_3$ corresponds to the B4 size, and $T_1+T_2+T_3$ corresponds to the A3 size. The heating segments have energization heating member material layers having the same volume resistance value and the same thickness. Then, widths $W_1$, $W_2$, and $W_3$ of the heating segments are adjusted, so that the heating segments have the same heating amounts per unit length in the longitudinal direction of the heater.

The heating amount per unit length of each heating segment is given by:

$$\frac{V^2}{\left[\frac{\sigma \times T_i}{W_i \times t_s}\right]} \times \frac{1}{T_i} \qquad i = 1, 2, 3$$

where $\sigma$ is the volume resistance value of the material of an energization heating member 503, and $t_s$ is the thickness of the energization heating member 503

Therefore, the heating amounts per unit length of the heating segments are equal to each other by setting $W_1:W_2:W_3 = T_1^2:T_2^2:T_3^2$.

In FIG. 12, the widths ($W_1$, $W_2$, $W_3$) of the heating segments are set to be different from each other so that the heating amounts per unit length obtained when each heating segment consists of a material having the same volume resistance value are equal to each other. However, the heating segments may consist of heating member materials having different volume resistance values, and the widths of the heating segments may be set to be equal to each other.

Also, the thicknesses of the heating segments may be changed.

Furthermore, when a recording member having a width smaller than that of the A4 size is rarely used in the heater shown in FIG. 12, only the heating segment having the length $T_3$ in FIG. 12 may consist of a heating member material having a smaller temperature—resistance characteristic. This is because since a non-paper feeding area is rarely formed in the heating segment of the length $T_3$, a non-paper feeding portion temperature rise occurs only for a short period of time, and a damage to the film, the pressing roller, and the like is small.

In the above embodiment, the electrodes 101 and 102, and the like may be arranged on one side of the heater 100, and the like in place of being distributed on the two sides thereof.

As described above, according to the present invention, since the power supply electrodes are arranged on the energization heating member to alternately have different polarities in a direction perpendicular to the feeding direction of the recording member, a desired energization amount can be attained even by a material having a high volume resistance value.

Also, since the energization heating member consists of a material having a large positive TCR, a temperature rise of a non-paper feeding portion can be reduced.

Figures 14, 15:
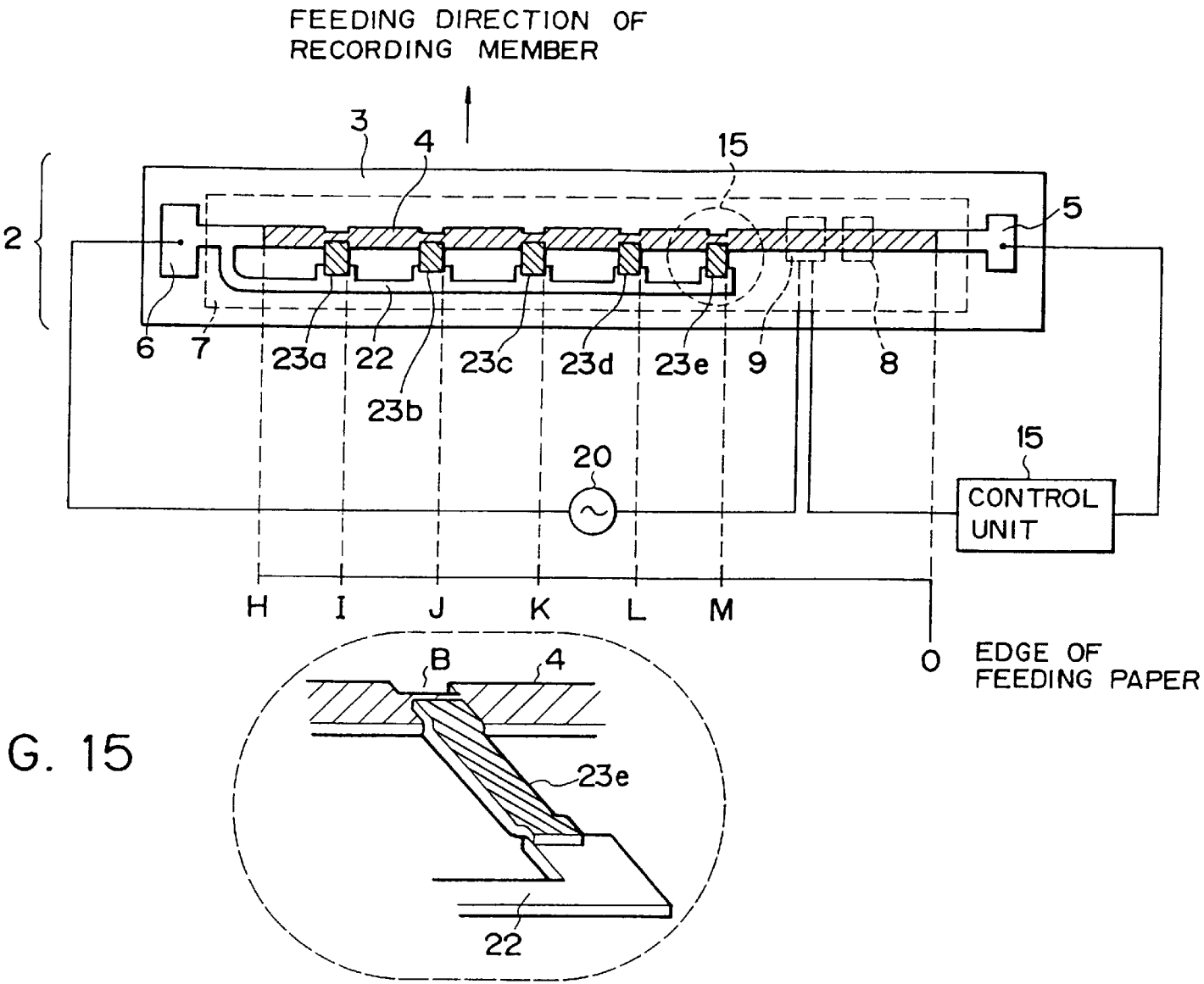
FIG. 14 is a detailed view of a heater according to another embodiment of the present invention, and a block diagram showing an energization control system.
FIG. 15 is a partially enlarged perspective view of the heater shown in FIG. 14.

FIG. 14 shows a heater according to another embodiment of the present invention. Note that the heater of this embodiment can be used in the image heating device shown in FIG. 1.

A heater 2 of this embodiment comprises:

a. an electrically insulating, heat-resistant, and low-heat capacity elongated ceramic substrate 3, which has its longitudinal direction extending in a direction substantially perpendicular to the feeding direction of a film 1, and consists of, e.g., $Al_2O_3$ (alumina), AlN, SiC, or the like;

b. an energization heat generating member 4 which is formed into a stripe- or band-shaped pattern along the longitudinal direction of the substrate at the central portion, in the widthwise direction, of one surface (face) of the substrate 3, serves as a heat source, and consists of a silver/palladium alloy (Ag/Pd), or the like;

c. power supply electrodes 5 and 6;

d. an electrically insulating overcoat layer 7 of, e.g., glass serving as a surface protective layer which covers the energization heating member forming surface of the substrate 3;

e. a temperature detection element 8 such as a thermistor and a temperature fuse 9 as a temperature detection element (thermal protector) for a safety countermeasure, which are arranged to be in contact with the other surface side (back side) of the substrate 3; and the like.

The overcoat layer 7 side of the heater 2 corresponds to the film sliding contact surface side, and the heater 2 is fixed and supported by a support portion (not shown) via a heat-insulating heater holder 13 to expose this surface side externally.

The temperature of the heater 2 rises when a voltage is applied from an AC power supply 20 across the power supply electrodes 5 and 6 at the two ends of the energization heating member 4, and the energization heating member 4 generates heat.

The temperature of the heater 2 is detected by the temperature detection element 8 on the back side of the substrate, and the detected information is fed back to an energization control unit 15. The control unit 15 controls energization from the AC power supply 20 to the energization heating member 4 based on the detected information, thereby executing temperature control, so that the temperature of the heater 2 detected by the temperature detection element 8 upon execution of fixing becomes a predetermined temperature (fixing temperature).

The temperature control of the heater 2 is realized by adopting a method of controlling the applied voltage or current to the energization heating member 4, or a method of controlling the energization time. As the method of controlling the energization time, zero-crossing wave number control for controlling energization and non-energization states in units of half cycles of a power supply waveform, and phase control for controlling the phase angle to be energized in units of half cycles of a power supply waveform are known.

More specifically, the output from the temperature detection element (thermistor) 8 is A/D-converted, and is fetched by a CPU. Based on the fetched information, an AC voltage to be applied to the energization heating member 4 is pulse-width-modulated by the phase control, wave number control, or the like by a TRIAC, thereby controlling energization to the energization heating member 4, so that the temperature of the heater detected by the temperature detection element 8 becomes constant.

The temperature fuse 9 is arranged in the vicinity of or to be in contact with the back of the substrate 3 of the heater 2 while being connected in series with the energization path to the energization heating member 4. When the energization of the energization heating member 4 goes wrong, and the heater 2 causes an abnormal temperature rise (thermal runaway of the heater), the temperature fuse 9 operates to open the energization circuit to the energization heating member 4, thereby disabling energization to the energization heating member.

Figure 16:
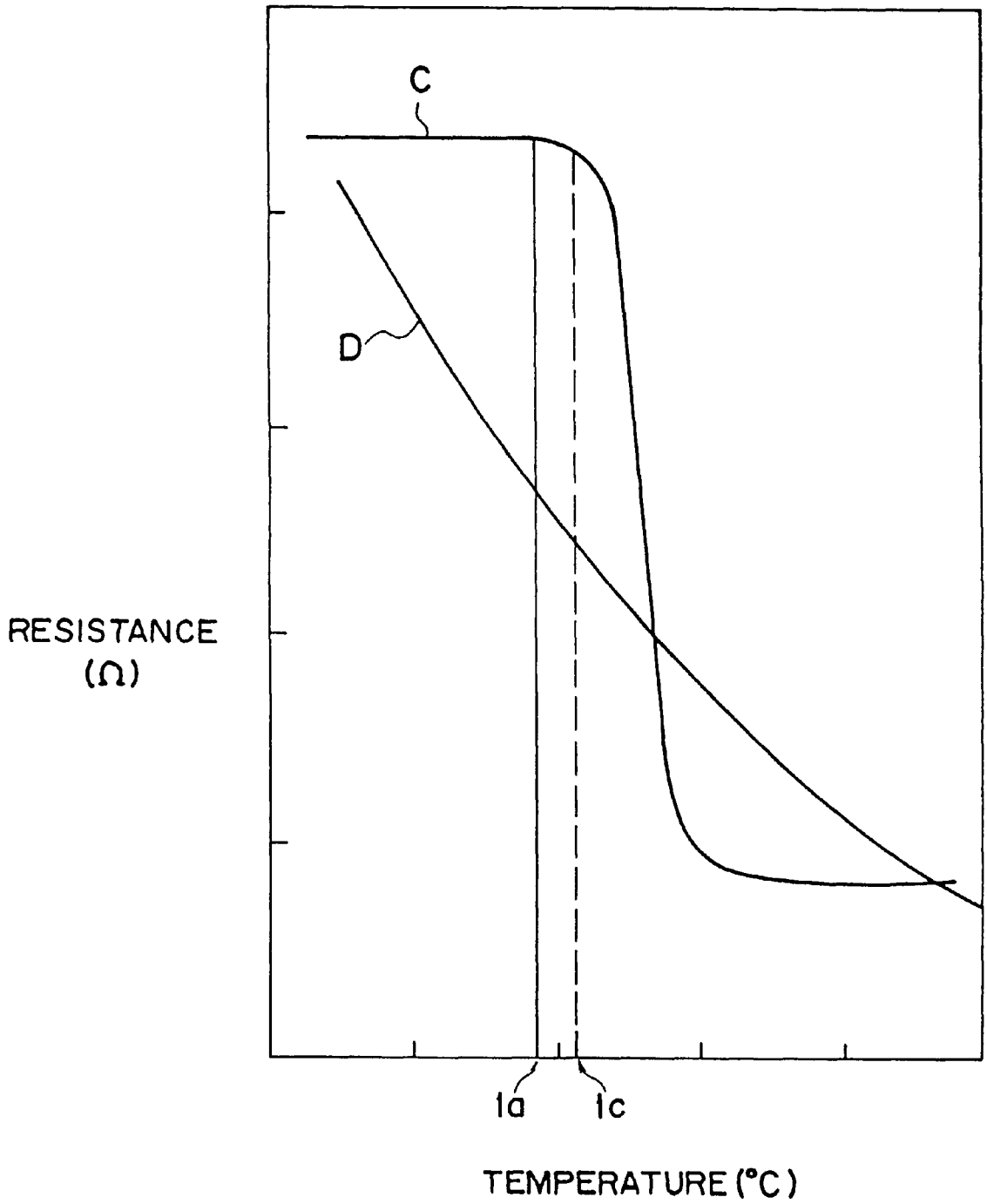
FIG. 16 is a graph showing the temperature—resistance characteristic of a resistor in FIG. 14.

An intermediate portion, in the longitudinal direction (a direction perpendicular to the feeding direction of a recording member) of the energization heating member 4 is connected to one end of each resistor 23 (23*a* to 23*e*) having a negative temperature—resistance characteristic (TCR), as indicated by a curve C in FIG. 16. The other end of each resistor 23 is connected to an electrode 22 having the same polarity as that of the electrode 6. A recording member is fed based on a one-sided reference using a line O on the side of the electrode 5 as a reference. A paper feeding area for the A3 size corresponds to a portion between H and O, a paper feeding area for the B4 size corresponds to a portion between I and O, a paper feeding area for the A4 size corresponds to a portion between J and O, a paper feeding area for the B5 size corresponds to a portion between K and O, a paper feeding area for the A5 size corresponds to a portion between L and O, and a paper feeding area for the postcard size corresponds to a portion between M and O.

When a recording member has the A3 size, the energization heating member is energized between O and H. When a B4-size recording member is fed, the temperature of the resistor 23*a* located on a non-paper feeding area (between H and I) increases due to a non-paper feeding portion temperature rise. Thus, the resistance value of the resistor 23*a* decreases, and a current which is supposed to flow between H and I of the energization heating member 4 is supplied to the electrode 22 having a lower resistance than that of the energization heating member 4. For this reason, the heating amount between H and I of the energization heating member 4 decreases, and the non-paper feeding portion temperature rise can be eliminated.

When an A4-size recording member is fed, the temperature between H and J increases, and the resistance values of the resistors 23*a* and 23*b* decrease, thus decreasing the heating amount between H and J.

Similarly, when a B5-, A5-, or postcard-size recording member is fed, the resistance values of the resistors 23 corresponding to a non-paper feeding area decrease due to a temperature rise, and the current flows from the energization heating member 4 to the electrode 22. Thus, the heating amount on the non-paper feeding area decreases, and a non-paper feeding portion temperature rise can be eliminated.

In a connection portion between the energization heating member 4 and each resistor 23, as indicated by B in FIG. 15 as an enlarged view of FIG. 14, the width of the energization heating member 4 is decreased, so that the heating amount of the connection portion becomes larger than that of a non-connection portion by heat relieved to the resistors 23.

In this embodiment, the electrode 22 may comprise a resistor.

When the temperature—resistance characteristic of the resistor 23 has a temperature (phase shift temperature) Tc at which the resistance value abruptly changes, as indicated by the curve C in FIG. 16, this temperature Tc is set to be higher than a temperature Ta at which the heater 2 is controlled by the thermistor 8. In this manner, when the temperature of a non-paper feeding portion becomes higher than the temperature Ta of a paper feeding portion, the resistance value of the resistor 23 decreases, thus eliminating a non-paper feeding portion temperature rise.

Needless to say, if the resistor has a negative TCR, the above-mentioned effect can be obtained when it does not have any temperature (phase shift temperature) Tc at which the resistance value abruptly changes, as indicated by a curve D in FIG. 16. In addition, the TCR is preferably 1,000 PPM/° C. or more.

Figure 17:
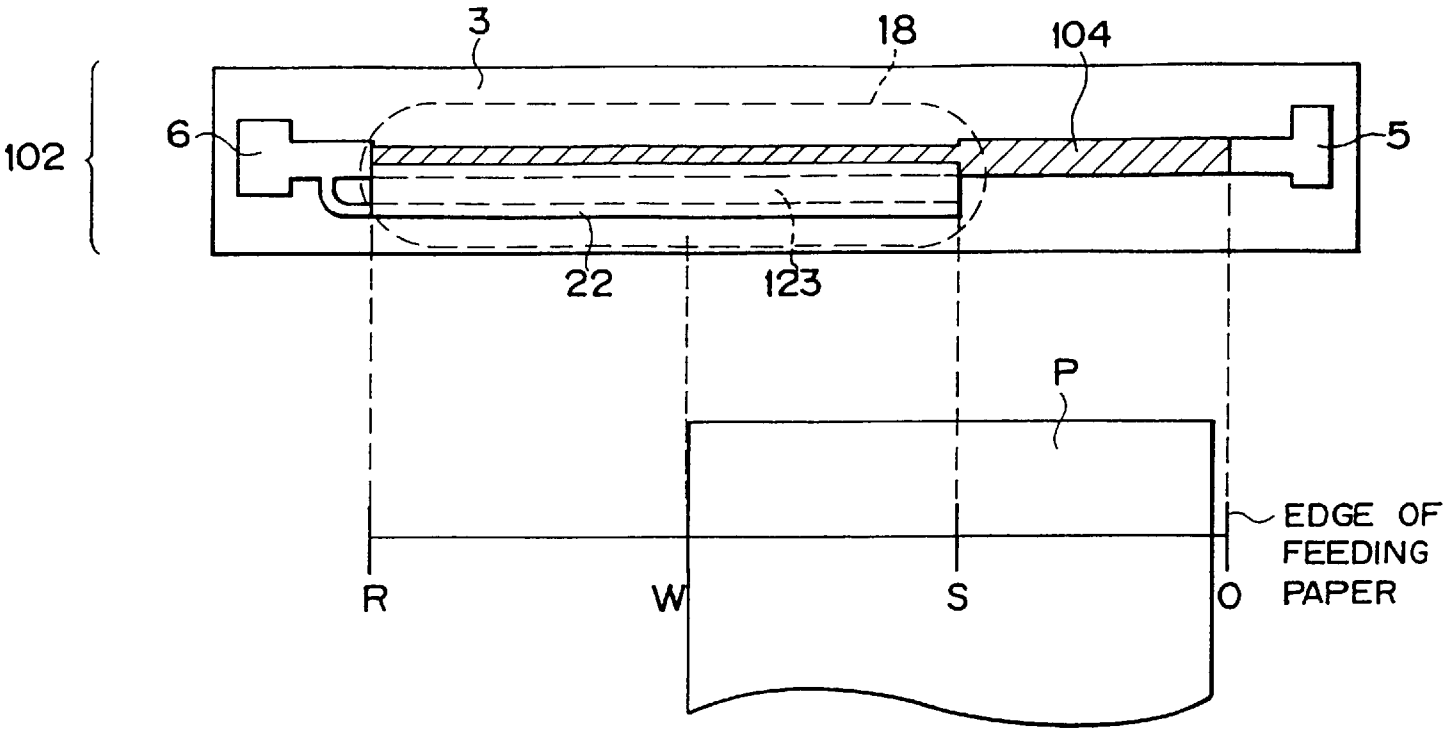
FIG. 17 is a detailed view of a heater according to still another embodiment of the present invention.
Figure 18:
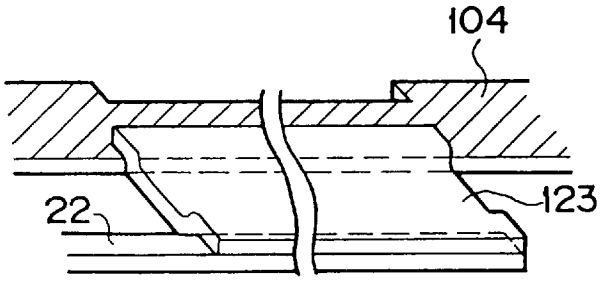
FIG. 18 is a partially cutaway enlarged view of FIG. 17.

FIG. 17 shows still another embodiment of the present invention. A heater 102 shown in FIG. 17 can cope with a case wherein a recording member having a width different from that of a specific paper size such as A3, B4, A4, or the like is fed. A resistor 123 has a negative TCR, and is arranged between the electrode 22 and an energization heating member 104, as shown in FIG. 18. An overcoat layer of glass (not shown) is formed on the energization heating member 104, the resistor 123, and the electrode 22 as in the above embodiment.

Assuming that a recording member P having an arbitrary width is fed, the temperature of the resistor 123 of an area between R and W increases due to a non-paper feeding portion temperature rise, the resistance value of the resistor 123 decreases, and a current leaks from the energization heating member 104 to the electrode 22, thus decreasing the heating amount of the area between R and W. Since the temperature on an area between S and W does not rise, the heating amount does not decrease since no current leaks from the energization heating member 104.

In the above embodiment, at the temperature Ta or less of the heater, which temperature is controlled by the thermistor, the resistance value of the resistor must be sufficiently higher than that of the energization heating member. This is because when the resistance value of the resistor 23 in the heater 2 shown in FIG. 14 is not sufficiently higher than that of the energization heating member 4 at the thermistor control temperature Ta or less, a current flows through resistors which do not correspond to a non-paper feeding area, and the heating amount of the energization heating member 4 gradually decreases toward the electrode 6 side, thus causing a fixing error.

Figure 19:
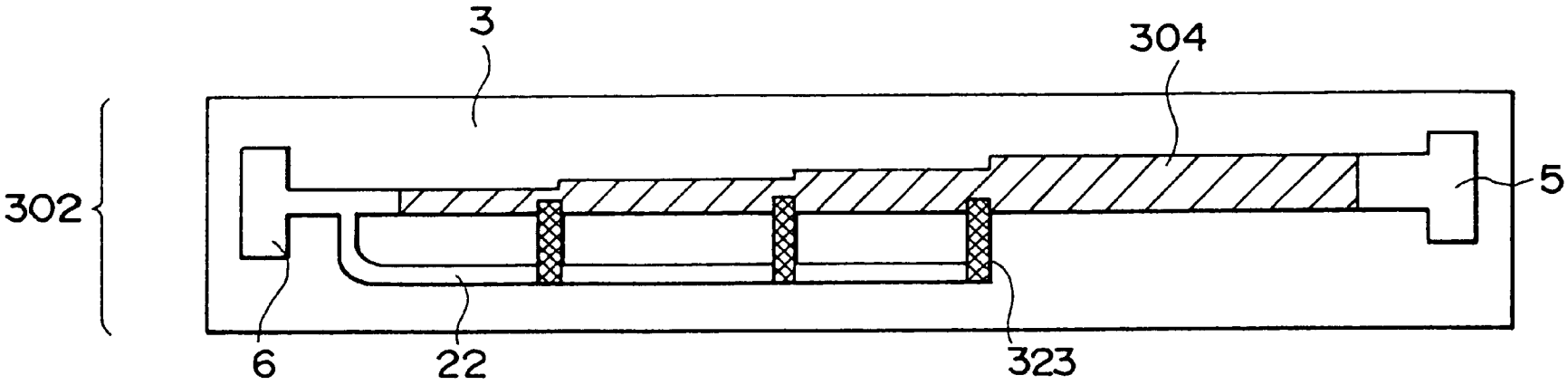
FIG. 19 is a detailed view showing a modification of a heater according to the present invention.
Figure 20:
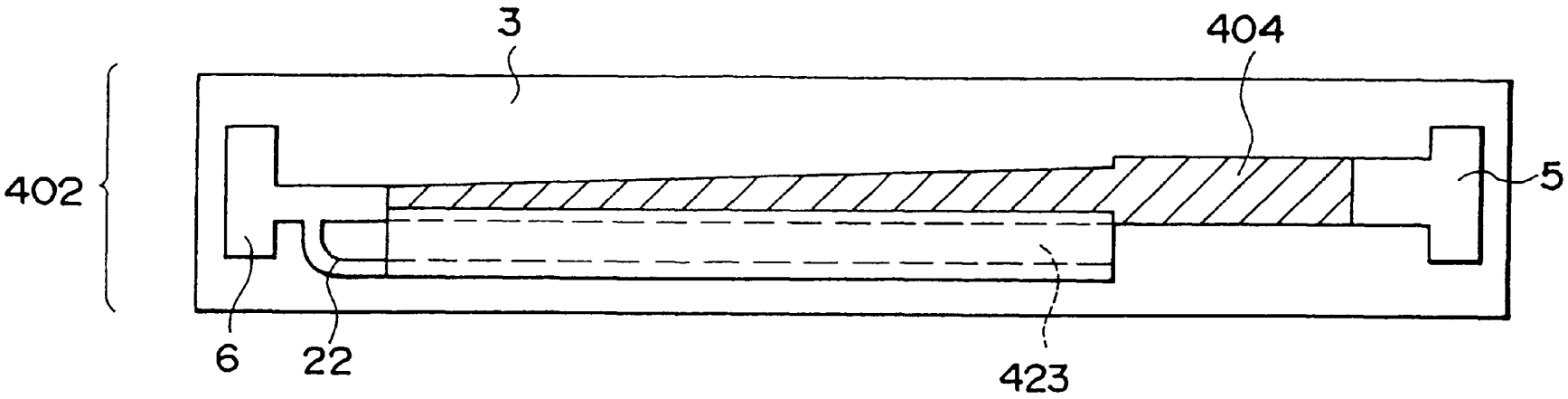
FIG. 20 is a detailed view showing another modification of the heater according to the present invention.

As a modification of the above embodiments, as shown in FIGS. 19 and 20, when the width of the energization heating member is gradually decreased toward the electrode 6 side, a fixing error can be prevented even when a resistor having a resistance which allows current flow at the thermistor control temperature Ta or less is used.

More specifically, in a heater 302 shown in FIG. 19, the width of the energization heating member on the side of the electrode 6 is sequentially decreased at each connection portion with a resistor 323. With this structure, even when a current leaks from the resistor 323, a decrease in heating amount $I^2r$ per unit length (r is the resistance value per unit length) can be prevented.

In a heater 402 shown in FIG. 20, the width of a portion of an energization heating member 404 connected to a resistor 423 is gradually decreased toward the electrode 6 side for the same reason as described above.

Figure 21A:
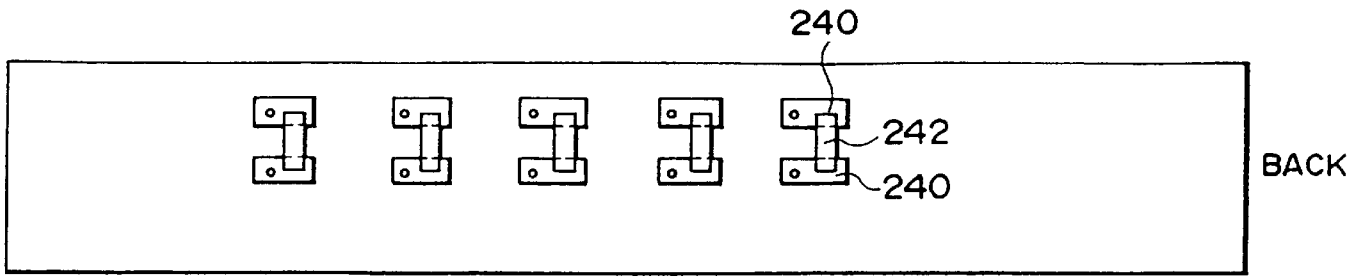
FIGS. 21A, 21B, and 21C are detailed views of a heater according to still another embodiment of the present invention.
Figure 21B:
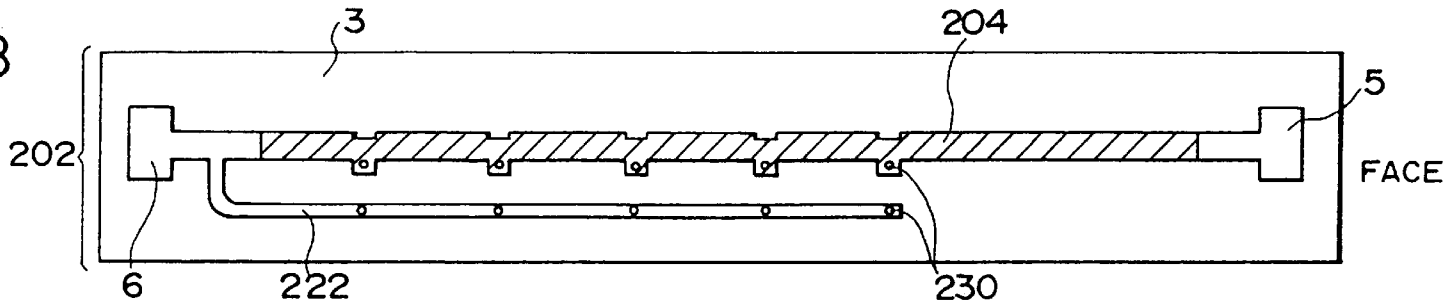
Figure 21C:
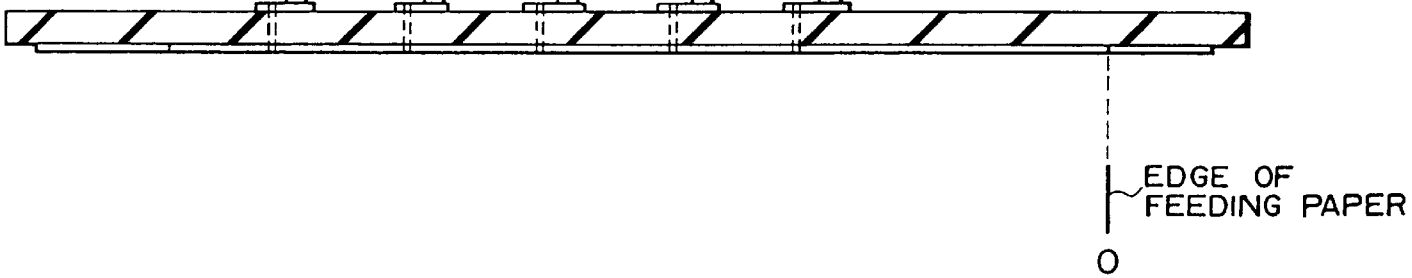

FIGS. 21A, 21B, and 21C show still another embodiment of the present invention. A heater 202 shown in FIG. 21B uses temperature switch elements 242 each of which starts energization when the temperature becomes equal to or higher than a specific temperature Ts higher than the thermistor control temperature Ta; and stops energization when the temperature becomes lower than Ts.

A branch path extending to an electrode 222 via through holes 230, electrodes 240, and the temperature switch elements 242 is arranged halfway through the longitudinal direction of an energization heating member 204.

When a recording member having a small width is fed to the heater 202, the temperature of the temperature switch element 242 on a non-paper feeding area exceeds Ts due to a non-paper feeding portion temperature rise, and the temperature switch element is enabled to shunt a current from the energization heating member 204 to the electrode 222, thus stopping heating of the non-paper feeding area.

When heating of the non-paper feeding area is stopped, the temperature of the temperature switch element is decreased to a temperature lower than Ts. When the switch element is disabled, heating of the non-paper feeding area is started again, and the temperature of this area rises again. When the temperature exceeds Ts, the temperature switch element 242 is enabled again. Since such a cycle is repeated, a time average of the heating amount of the non-paper feeding area is decreased, thereby eliminating a non-paper feeding portion temperature rise.

In the heater used in this embodiment, the electrodes, the energization heating member, the resistor, and the glass overcoat layer are formed on an alumina substrate by screen-printing and calcining corresponding thick film printing pastes.

The electrodes are formed by screen-printing, drying, and calcining a thick film printing paste which is prepared by mixing a conductive filler such as Ag, Ag/Pt, Au, Ag/Pd, Pt, Ni, or the like, an inorganic binder such as borosilicate glass which melts upon sintering to obtain a desired adhesion force with the substrate, an organic binder such as cellulose for obtaining a certain viscosity as a printing paste, a solvent such as terpineol, and an inorganic additive for increasing the adhesion force with the substrate.

The energization heating member is formed by printing, drying, and calcining a thick film printing paste using Ag/Pd or the like as a conductive filler. Also, the resistor is formed by printing, drying, and calcining a thick film printing paste using an Mn—Ni—Co—Fe-based oxide, $VO_2$, $Ag_2S$, or the like as a conductive filler.

The overcoat layer is formed by printing, drying, and calcining a thick film printing paste prepared by mixing an inorganic binder such as borosilicate glass, an organic binder such as cellulose, and a solvent such as terpineol.

The resistor, electrodes, and energization heating member may be similarly formed by using a thin film forming process based on sputtering, CVD, or the like.

In addition, as the temperature switch element used in the heater shown in FIGS. 21A to 21C, a known switch such as an element for turning on/off a contact by utilizing a bimetal or by utilizing the fact that a ferromagnetic member loses magnetization at high temperatures, may be used.

The embodiments of the present invention have been described. However, the present invention is not limited to these embodiments, and various modifications may be made within the spirit and scope of the invention.

What is claimed is:

1. An image heating device comprising:

a heater; and a film having one surface contactable to said heater and the other surface contactable to a recording member which supports an image, said film being movable with the recording member said heater comprising a resistor for generating heat upon energization, and electrodes for energizing said resistor, wherein said electrodes are provided to alternately have different polarities relative to a direction perpendicular to a moving direction of the recording member within a width of said resistor along the direction perpendicular to a moving direction of the recording material, and wherein said resistor has a predetermined width portion having a predetermined width along a moving direction of the recording member and a protruding portion protruded from said predetermined width portion in the moving direction of the recording member, and said electrodes overlap with said protruding portions.

2. A device according to claim 1, wherein said heater has a long shape extending in a direction perpendicular to the moving direction of the recording member.

3. A device according to claim 1, wherein said energization electrodes are arranged at equal intervals.

4. A device according to claim 1, wherein the image is fixed on said recording member with heat from said heater through said film.

5. An image heating device according to claim 1, wherein said resistor has a positive resistance temperature characteristic.

6. An image heating device according to claim 5, wherein the resistance-temperature characteristic is not less than 1000 PPM/° C.

7. An image heating device according to claim 1, wherein said device can use recording members with plural predetermined sizes, and positions of said electrodes correspond to positions of side edges of the recording members in any of the predetermined sizes.

8. An image heating device according to claim 1, wherein the predetermined width of said resistor corresponds to a width of said resistor portion in a moving direction of a recording member to which said electrodes are not connected.

9. An image heating device according to claim 1, wherein a main ingredient of said resistor is $RuO_2$.

10. A heater comprising:

an elongate substrate;

a resistor provided along a longitudinal direction of said substrate for generating heat by energization; and electrodes for energizing of said resistor;

wherein said electrodes are provided to alternately have different polarities relative to a longitudinal direction of said substrate, and wherein said resister has a predetermined width portion having a predetermined width along a direction perpendicular to a longitudinal direction of said substrate and a protruding portion protruded from said predetermined width portion in the direction perpendicular to the longitudinal direction of said substrate, and said electrodes overlap with said protruding portion.

11. A heater according to claim 10, wherein the predetermined width of said resistor corresponds to a width of said resistor portion in a direction perpendicular to a longitudinal direction of said substrate to which said electrode is not connected.

12. A heater according to claim 10, wherein said resistor has a positive resistance temperature characteristic.

13. A heater according to claim 12, wherein the resistance-temperature characteristic is not less than 100 PPM/° C.

14. A heater according to claim 10, wherein a main ingredient of said resistor is $RuO_2$.

* * * * *

UNITED STATES PATENT AND TRADEMARK OFFICE

CERTIFICATE OF CORRECTION

PATENT NO. : 6,084,208

DATED : July 4, 2000

INVENTOR(S): KOICHI OKUDA, ET AL.

It is certified that error appears in the above-identified patent and that said Letters Patent is hereby corrected as shown below:

SHEET S2:
Figure 2, "MICRO-COMPUTER" should read --MICROCOMPUTER--.

COLUMN 1:
Line 50, "heading" should read --heating--.

COLUMN 5:
Line 33, "invention," should read --invention.--;
Line 40, "invention," should read --invention.--;
Line 45, "invention," should read --invention.--;
Line 46, "relation-ship" should read --relationships--; and
Line 60, "temperature_resistance" should read --temperature-resistance--.

COLUMN 6:
Line 5, "invention," should read --invention.--.

COLUMN 7:
Line 40, "100" should read --200--; and
Line 66, "such no" should read --no such--.

UNITED STATES PATENT AND TRADEMARK OFFICE

CERTIFICATE OF CORRECTION

PATENT NO. : 6,084,208

DATED : July 4, 2000

INVENTOR(S): KOICHI OKUDA, ET AL.

It is certified that error appears in the above-identified patent and that said Letters Patent is hereby corrected as shown below:

COLUMN 8:
Line 7, "temperature_resistance" should read --temperature-resistance--; and
Line 16, "temperature_resistance" should read --temperature-resistance--.

COLUMN 10:
Line 26, "member 503" should read --member 503.--; and
Line 44, "temperature_resistance" should read --temperature-resistance--.

COLUMN 12:
Line 11, "temperature_resistance" should read --temperature-resistance--;
Line 55, "to" should read --from--; and
Line 58, "temperature_resistance" should read --temperature-resistance--.

UNITED STATES PATENT AND TRADEMARK OFFICE

CERTIFICATE OF CORRECTION

PATENT NO. : 6,084,208

DATED : July 4, 2000

INVENTOR(S): KOICHI OKUDA, ET AL.

It is certified that error appears in the above-identified patent and that said Letters Patent is hereby corrected as shown below:

COLUMN 14:

Line 58, "recording member" should read --recording member,--.

Signed and Sealed this

Tenth Day of April, 2001

*Attest:*

Nicholas P. Godici

NICHOLAS P. GODICI

*Attesting Officer*

*Acting Director of the United States Patent and Trademark Office*